US007117083B2

(12) United States Patent
Rothman et al.

(10) Patent No.: US 7,117,083 B2
(45) Date of Patent: Oct. 3, 2006

(54) SYSTEM AND METHOD FOR ENABLING WIRELESS TRAFFIC MESSAGE PASSING

(75) Inventors: Michael A. Rothman, Puyallup, WA (US); Vincent J. Zimmer, Federal Way, WA (US)

(73) Assignee: Intel Corporation, Santa Clara, CA (US)

( * ) Notice: Subject to any disclaimer, the term of this patent is extended or adjusted under 35 U.S.C. 154(b) by 93 days.

(21) Appl. No.: 10/882,029

(22) Filed: Jun. 29, 2004

(65) Prior Publication Data

US 2005/0288849 A1 Dec. 29, 2005

(51) Int. Cl.
*G08G 1/0965* (2006.01)
*G08G 1/0967* (2006.01)

(52) U.S. Cl. ..... 701/200; 701/117; 340/995.13

(58) Field of Classification Search ..... None
See application file for complete search history.

(56) References Cited

U.S. PATENT DOCUMENTS 5,257,023 A * 10/1993 Furuya ..... 340/995.13
5,739,773 A * 4/1998 Morimoto et al. ..... 340/990
6,107,940 A * 8/2000 Grimm ..... 340/905
6,317,682 B1 * 11/2001 Ogura et al. ..... 701/117
6,466,862 B1 * 10/2002 DeKock et al. ..... 701/117
6,781,523 B1 * 8/2004 Matsui et al. ..... 340/910
6,801,837 B1 * 10/2004 Carlstedt et al. ..... 701/1
6,931,320 B1 * 8/2005 Mori et al. ..... 701/212
2004/0204845 A1 * 10/2004 Wong ..... 701/210

FOREIGN PATENT DOCUMENTS

DE 4138050 A1 * 5/1993
DE 4411125 A1 * 10/1994

OTHER PUBLICATIONS

FC NEWS; New service at 5.9GHz for Dedicated Short—Range Communications Will Enhance Public Safty;http://hraunfoss.fcc.gov/edocs_public/attachmatch/DOC-242309A1.pdf; dates site visited Jun. 29, 2004, Mar. 7, 2006.

* cited by examiner

*Primary Examiner*—Michael J. Zanelli
(74) *Attorney, Agent, or Firm*—Crystal D. Sayles

(57) ABSTRACT

A system and method for enabling wireless traffic message passing. The method includes initializing a vehicle wireless subsystem and a highway wireless subsystem, enabling a vehicle transponder to broadcast a query to request real-time traffic pattern data, and if a response to the query has been received, incorporating the real-time traffic pattern data into a runtime database and creating a human-readable display for displaying the runtime database on a navigation system. The human-readable display of the traffic pattern data includes the display of free-flowing traffic, slow moving traffic, and stopped traffic on a map to allow the driver to change a planned travel route if slow and stopped traffic pattern conditions exit on the planned travel route.

33 Claims, 6 Drawing Sheets

300

400

```
typedef struct {
 CMD_TYPE       Command;~402
 GUID           Identification;~404
 UINT64         TimeStamp;~406
 UINT16         EntryCount;~408
 TRAFFIC_DATA   DataArray[EntryCount];~410
} H2V_PACKET; // Highway to Vehicle
```

FIG. 4A

420

```
typedef struct {
 CMD_TYPE       Command;~422
 GUID           Identification;~424
 UINT16         Direction;~426
 UINT64         TimeStamp;~428
 UINT16         EntryCount;~430
 TRAFFIC_DATA   DataArray[EntryCount];~432
} V2H_PACKET; // Vehicle To Highway
```

FIG. 4B

SYSTEM AND METHOD FOR ENABLING WIRELESS TRAFFIC MESSAGE PASSING

BACKGROUND OF THE INVENTION

1. Field of the Invention

Embodiments of the present invention are generally related to the field of intelligent highway systems. More particularly, embodiments of the present invention are related to a system and method for the dissemination of traffic conditions on the highway.

2. Description

Currently many vehicles are being manufactured to include navigation systems. The current state of navigation systems in vehicles is based on fixed maps using a GPS (Global Positioning System) to determine where the vehicle is located. The navigation system provides a user, while in the vehicle, with directions to be able to traverse streets, roads, and highways to get from point A to point B without much hassle. Some of the things that are not available today with navigation systems are (1) whether there is going to be congested traffic up ahead, (2) whether there are any road closures involved, (3) whether there are any detours ahead, or (4) any other obstacles that would prevent a driver from getting to his/her destination in a timely manner.

Currently, drivers cannot determine whether there is upcoming traffic congestion or some other type of road condition without having to listen to an appropriate traffic report on a radio station. Often times, even if the driver is able to hear the traffic report on the radio, it is at random whether the driver will be able to obtain the traffic information that the driver needs at the time the driver needs it (i.e., prior to already being in the location of the traffic jam).

On Dec. 17, 2003, the Federal Communications Commission (FCC) approved an Intelligent Transportation Systems (ITS) initiative that provides for a new signal frequency of 5.9 GHz (Giga Hertz) to be used for Intelligent Highways. See, http://hraunfoss=fcc=gov/edocs public/attachmatch/DOC-242309A1 =pdf. (It should be noted that periods have been replaced with equal signs in URLs within this document to avoid inadvertent hyperlinks.) The Intelligent Transportation Systems (ITS) initiative is intended for interstate highways as well as vehicles to have wireless transponders with an effective radius of roughly 100 yards that will enable the ability of a vehicle to know when to put brakes on to avoid a crash or when another vehicle is approaching. Thus, this initiative is basically a public safety measure where vehicles will be aware of what's going on immediately around them and highways, or at least interstates, will have transponders that will interact with all of the vehicles that pass by the transponders. This will allow a vehicle to have knowledge such as whether some other vehicle is coming up very quickly behind it, whether it is safe to change lanes, etc. The installation of the equipment for Intelligent Highways is expected to occur within the next five (5) years.

Although Intelligent Highways will provide public safety measures and alerts, such as collision avoidance, work zone warnings, or other road condition warnings, Intelligent Highways will not be able to provide traffic pattern data regarding highway congestion issues.

Thus, what is needed is a system and method for disseminating upcoming traffic conditions on highways to drivers. What is also needed is a system and method for disseminating real-time traffic pattern information regarding highway traffic conditions by augmenting a pre-existing short-range communication environment and vehicle navigation systems. What is further needed is a system and method that provides real-time traffic pattern information regarding highway traffic conditions to enable a driver to make appropriate choices in the selection of optimal travel routes.

BRIEF DESCRIPTION OF THE DRAWINGS

The accompanying drawings, which are incorporated herein and form part of the specification, illustrate embodiments of the present invention and, together with the description, further serve to explain the principles of the invention and to enable a person skilled in the pertinent art(s) to make and use the invention. In the drawings, like reference numbers generally indicate identical, functionally similar, and/or structurally similar elements. The drawing in which an element first appears is indicated by the leftmost digit(s) in the corresponding reference number.

FIG. 4A is an exemplary type definition structure for a highway to vehicle packet according to an embodiment of the present invention.

FIG. 4B is an exemplary type definition structure for a vehicle to highway packet according to an embodiment of the present invention.

DETAILED DESCRIPTION OF THE INVENTION

While the present invention is described herein with reference to illustrative embodiments for particular applications, it should be understood that the invention is not limited thereto. Those skilled in the relevant art(s) with access to the teachings provided herein will recognize additional modifications, applications, and embodiments within the scope thereof and additional fields in which embodiments of the present invention would be of significant utility.

Reference in the specification to "one embodiment", "an embodiment" or "another embodiment" of the present invention means that a particular feature, structure or characteristic described in connection with the embodiment is included in at least one embodiment of the present invention. Thus, the appearances of the phrase "in one embodiment" appearing in various places throughout the specification are not necessarily all referring to the same embodiment.

Embodiments of the present invention are directed to a system and method for disseminating real-time highway traffic information to vehicle drivers. Embodiments of the present invention leverage Intelligent Highways and navigation systems to provide drivers with the ability to make appropriate choices in the selection of optimal travel routes. This is accomplished by using peer-to-peer dissemination of real-time traffic data. The real-time traffic data may be passed from a vehicle to a highway marker, from a highway marker to a vehicle, from a highway marker to another highway marker, and from one vehicle to another vehicle. The real-time traffic data may be incorporated into a vehicle navigation system to intelligently re-route the travel route of a driver based on traffic conditions.

Although embodiments of the present invention are described for highways, the invention is not limited to highways. One skilled in the relevant art(s) would know that the invention is equally applicable to streets and roads having transponders capable of peer-to-peer communications.

Embodiments of the present invention are described as being implemented by leveraging what will be a pre-existing short-range communication environment used in Intelligent Highways and current vehicle navigation systems. One skilled in the relevant art(s) would know that embodiments of the present invention may also be implemented using other types of sensors and future vehicle navigation systems as well.

Figure 1:
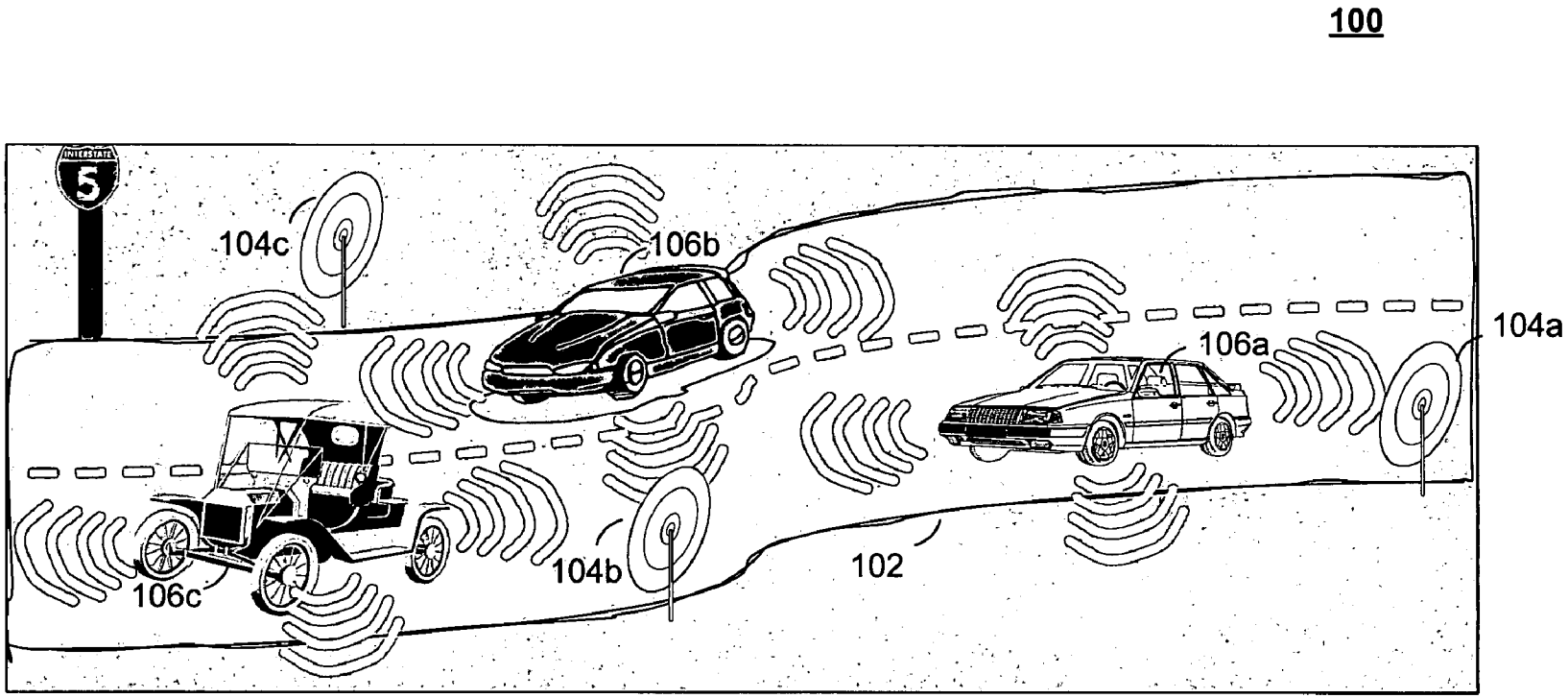
FIG. 1 is a block diagram illustrating an exemplary Intelligent Highway.

FIG. 1 is a block diagram illustrating an exemplary Intelligent Highway 100. Intelligent Highway 100 comprises a highway 102 with a plurality of highway transponders 104*a*, 104*b*, and 104*c* (also referred to as highway markers) spaced at pre-determined distances along highway 102. For example, an FCC Intelligent Transportation System initiative indicates that each transponder may have an effective radius of approximately 100 yards. Therefore, highway transponders 104*a*, 104*b*, and 104*c* may be spaced at approximately 100 yard distances apart for transponders located on the same side of the road. Highway 102 also includes vehicles 106*a*, 106*b*, and 106*c* traveling along highway 102. Each of vehicles 106*a*, 106*b*, and 106*c* may also include transponders 104*d*, 104*e*, and 104*f* (not explicitly shown) located within vehicles 106*a*, 106*b*, and 106*c* that are capable of communicating with transponders 104*a*, 104*b*, and 104*c*.

As previously indicated, embodiments of the present invention enable peer-to-peer communications between vehicular transponders and highway transponders. Each highway transponder 104*a*, 104*b*, and 104*c* is capable of transmitting and receiving traffic data to and from each vehicle transponder 104*d*, 104*e*, and 104*f* as each vehicle 106*a*, 106*b*, and 106*c* passes by, or comes in contact with, each highway transponder 104*a*, 104*b*, and 104*c*. For example, as vehicle 106*a* passes highway transponder 104*a*, vehicle 106*a* may request that highway transponder 104*a* provide it with current traffic information stored on highway transponder 104*a*. Also, highway transponder 104*a* may request that vehicle 106*a* provide it with current traffic information stored on vehicle 106*a*.

Figure 2A:
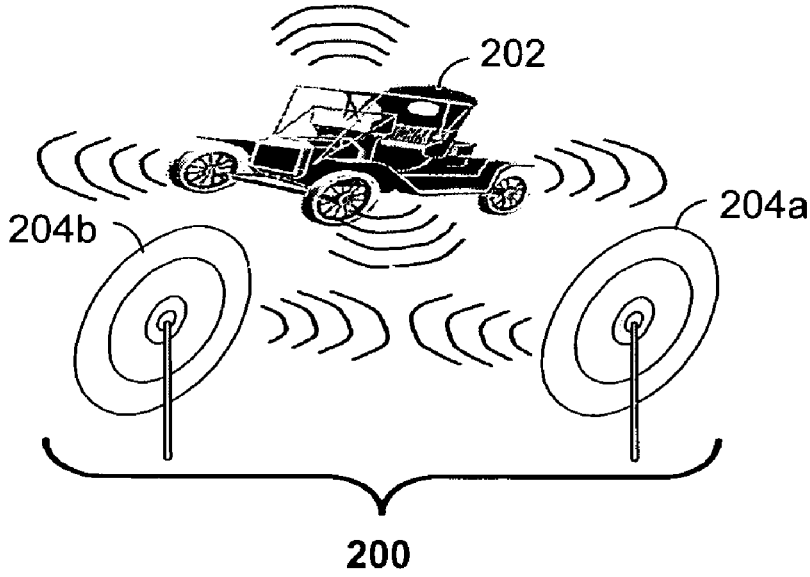
FIG. 2A is a diagram illustrating an exemplary method for passing locality status data from one highway transponder to another according to an embodiment of the present invention.

Peer-to-peer communications may also occur between highway transponders. FIG. 2A is a diagram 200 illustrating an exemplary method for passing locality status data from one highway transponder to another according to an embodiment of the present invention. Diagram 200 shows a vehicle 202 and two highway transponders 204*a* and 204*b*. If highway transponders 204*a* and 204*b* are located within a predetermined radius that enables highway transponders 204*a* and 204*b* to communicate, then highway transponders 204*a* and 204*b* may pass traffic data information to each other. For example, if highway transponder 204*b* has passed traffic data information to highway transponder 204*a*, when vehicle 202 passes highway transponder 204*a*, vehicle 202, after requesting traffic data information from highway transponder 204*a*, will know about traffic data information on highway transponder 204*b* even though vehicle 202 has not come in contact with highway transponder 204*b*. In one embodiment, a highway transponder may collect data from other highway transponders located north and south as well as east or west of the highway transponder. Therefore, when a vehicle passes a highway transponder, the highway transponder may provide traffic information of interest to vehicles traveling in all directions (i.e., north, south, east, and west).

Figure 2B:
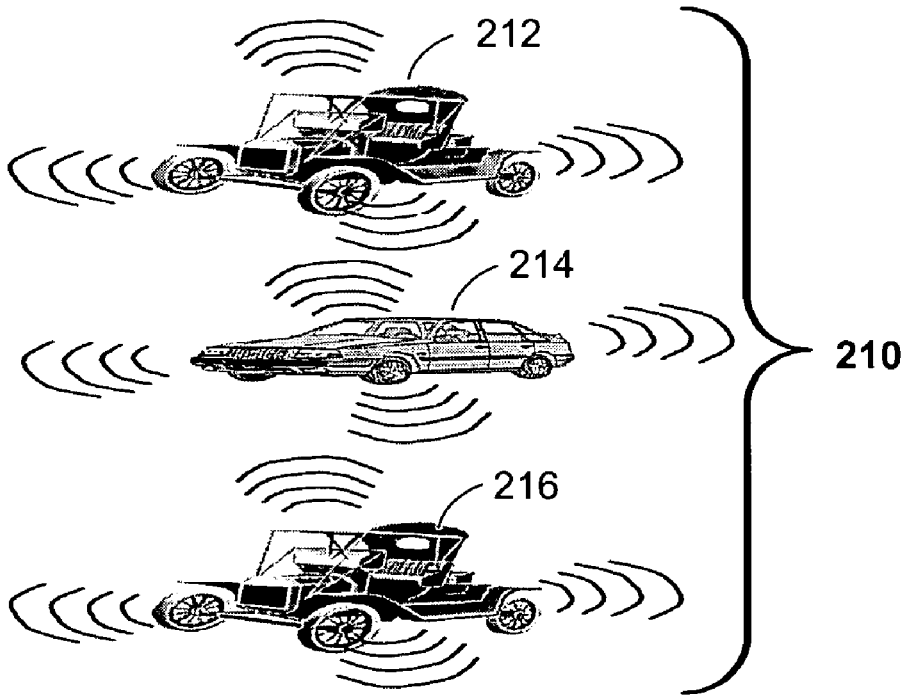
FIG. 2B is a diagram illustrating an exemplary method for passing locality status data from one vehicle to another according to an embodiment of the present invention.

Peer-to-peer communications may also occur between vehicles by way of vehicle transponders. FIG. 2B is a diagram 210 illustrating an exemplary method for passing locality status data from one vehicle to another according to an embodiment of the present invention. Diagram 210 shows three vehicles 212, 214, and 216 passing traffic data information from one vehicle to another. For example, vehicle 212 is shown passing traffic data information to vehicle 214. Vehicle 214 is shown passing traffic data information to vehicles 212 and 216. Vehicle 216 is shown passing traffic data information to vehicle 214. Thus, vehicle 212 may pass information to vehicle 214 and vehicle 214 may pass information from both vehicles 212 and 214 to vehicle 216. Also, vehicle 216 may pass information to vehicle 214 and vehicle 214 may pass information from both vehicles 216 and 214 to vehicle 212.

By using peer-to-peer dissemination of data, a driver can receive traffic data information when not on a highway. For example, if one vehicle has just left the highway onto a side street while another vehicle is on the same side street headed in the direction of the highway, their peer-to-peer communication will provide the vehicle heading toward the highway with traffic information without ever having driven onto the highway. The driver of the vehicle headed toward the highway will be provided with traffic data information prior to his/her arrival on the highway, and may decide to take an alternate route if the traffic data information indicates that traffic conditions on the highway are congested.

Figure 3:
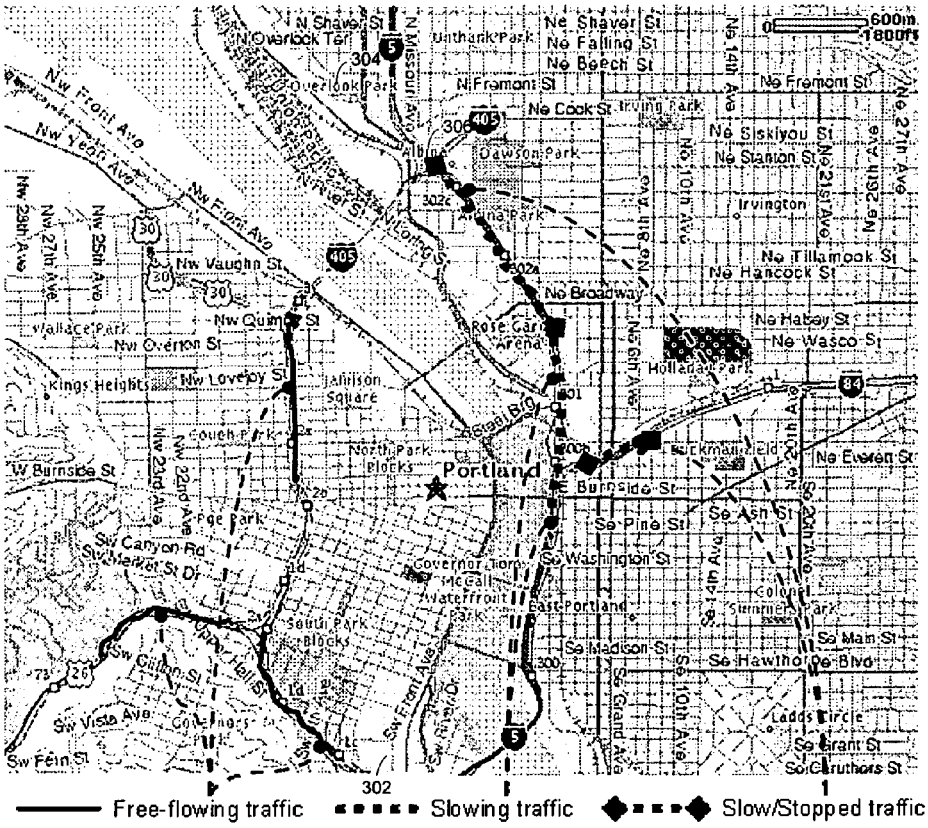
FIG. 3 is a diagram illustrating an exemplary map from a vehicle navigation system showing traffic patterns received from peer-to-peer communications according to an embodiment of the present invention.

As previously indicated, the peer-to-peer communications described in detail above may be incorporated on vehicle navigation systems to provide drivers with real-time traffic information to enable drivers to intelligently re-route their course based on traffic conditions. FIG. 3 is a diagram illustrating an exemplary map 300 from a vehicle navigation system displaying traffic patterns received from peer-to-peer communications according to an embodiment of the present invention. Map 300 shows free flowing traffic, slowing traffic, and slow/stopped traffic on highways in the state of Oregon. Map 300 identifies free-flowing traffic using a thick solid line, slowing traffic using a thick dotted line, and slow/stopped traffic using a thick dotted line surrounded by diamonds on each end.

A driver leaving from SW Front Avenue (identified on map 300 as 302) going north with a destination of Overlook Park (identified on map 300 as 304) may have initially charted a path to Overlook Park 304 using Route 5 heading north. Assuming that the driver has received traffic information from vehicles traveling southbound, coming off of Route 5 and Route 405 prior to the driver's travel onto Route 5, the driver will have information regarding highway conditions for both Route 5 and Route 405 as shown in FIG. 3. After viewing the traffic information received from peer-to-peer communications with other vehicles as well as highway transponders on the vehicle navigation system, the driver is alerted to the fact that using Route 5 will slow his pace considerably. Map 300 indicates that Route 5 is plagued with slowing traffic as well as slow/stopped traffic. The driver is also alerted to the fact that the traffic on Route 405 heading north is free flowing. At the intersection where Route 5 and Route 405 cross (indicated on map 300 as 306), the driver is also alerted that the traffic on Route 5 northbound at this point is free flowing. The driver may then re-route his path to take Route 405 going north and then take Route 5 going north at the intersection where Route 405 and Route 5 cross (i.e., 306). Thus, by populating the map on the vehicle navigation system with the peer-to-peer communications shared amongst vehicles and highway transponders, drivers are able to intelligently re-route their travel route to their destination.

The amount of data any one highway or vehicle transponder may be able to store depends on the size of the memory associated with the transponder. In one embodiment, highway transponders may have equal or smaller memory capacities than vehicle transponders. In another embodiment, vehicle transponders may have equal or smaller memory capacities than highway transponders. In one embodiment, the highway transponders may be able to store data from 100 highway and vehicle transponders while the vehicle transponders may be able to store data from 100 or more highway and vehicle transponders. In another embodiment, the vehicle transponders may be able to store data from 100 highway and vehicle transponders while the highway transponders may be able to store data from 100 or more highway and vehicle transponders. In yet other embodiments, each transponder may be able to store data from 1000 or more transponders, 10,000 or more transponders, 100,000 or more transponders, etc. Thus, the limit regarding how much storage capability each transponder may have is implementation specific.

FIG. 4A is an exemplary type definition structure for a highway to vehicle packet 400 according to an embodiment of the present invention. As its name implies, highway to vehicle packet 400 contains data from a highway transponder that is being sent to a vehicle transponder. The vehicle transponder then sends the information to a navigation system database to update a map, such as map 300, which displays the traffic patterns on the navigation system. In embodiments, highway to vehicle packet 400 may be used to transfer data between highway transponders as well.

In one embodiment, highway to vehicle packet 400 includes a command 402, an identifier 404, a timestamp 406, an entry count 408, and a data array 410. Command 402 may be, but is not limited to, a read or write command. For example, a highway transponder may request to read data from a vehicle transponder or to write data to a vehicle transponder. Identifier 404 may be a unique identifier, such as, but not limited to, a GUID (Globally Unique Identifier), that identifies the highway transponder sending highway to vehicle packet 400. GUIDs are well known to those skilled in the relevant art(s). Timestamp 406 may be the time at which the request is being made. Entry count 408 may refer to the number of entries that are being sent in data array 410. For example, if a highway transponder has 20 entries from other highway transponders and vehicle transponders, entry count 408 will be 20. If the highway transponder has 100 entries from other highway transponders and vehicle transponders, entry count 408 will be 100. Data array 410 comprises an array of data that stores the traffic information retrieved from other highway transponders and vehicle transponders. In one embodiment, data array 410 may include a timestamp indicating when the data from a particular highway or vehicle transponder was initially retrieved. Including a timestamp with each entry of data enables data retrieved before a specific time to be purged from the database, thereby enabling the navigation system to map current data. Although highway to vehicle packet 400 is described containing five entries (402, 404, 406, 408, and 410), these entries are provided as examples only. One skilled in the relevant art(s) would know that highway to vehicle packet 400 may contain more or less entries, as well as different types of entries, than those indicated above.

FIG. 4B is an exemplary type definition structure for a vehicle to highway packet 420 according to an embodiment of the present invention. As its name implies, vehicle to highway packet 420 contains data from a vehicle transponder that is being sent to a highway transponder. In embodiments, vehicle to highway packet 420 may be used to transfer data between vehicle transponders as well.

Vehicle to highway packet 420 is very similar to highway to vehicle packet 400 with the exception of a direction field. In one embodiment, vehicle to highway packet 420 includes a command 422, an identifier 424, a direction 426, a timestamp 428, an entry count 430 and a data array 432. Command 422 may be, but is not limited to, a read or write command. For example, a vehicle transponder may request to read data from a highway transponder or to write data to a highway transponder. Identifier 424 may be a unique identifier, such as, but not limited to, a GUID, that identifies the vehicle transponder sending vehicle to highway packet 420. Direction 426 may be the direction in which the vehicle is traveling. Timestamp 428 may be the time at Which the request is being made. Entry count 430 may refer to the number of entries that are being sent in data array 432. Data array 432 comprises an array of data that stores the traffic information retrieved from other highway transponders and vehicle transponders. In one embodiment, data array 432 may include a timestamp indicating when the data from a particular highway or vehicle transponder was initially retrieved. As indicated above, including a timestamp with each entry of data enables data retrieved before a specific time to be purged from the database, thereby enabling the highway transponder to contain current data. Although vehicle to highway packet 420 is described containing six entries (422, 424, 426, 428, 430, and 432), these entries are provided as examples only. One skilled in the relevant art(s) would know that vehicle to highway packet 420 may contain more or less entries, as well as different types of entries, than those indicated above.

Embodiments of the present invention include logic for monitoring traffic information within a vehicle and logic for monitoring traffic information within a highway transponder. Prior to describing embodiments for monitoring traffic information for vehicles as well as highway transponders, the minimum granularity to determine the location of a vehicle and highway time vs. vehicle time will be discussed.

Assuming that a highway transponder has a 1 GHz clock, the minimum granularity by which the location of a vehicle may be determined is shown in equation (1) below.

$$D_{min}=c*5{,}280/\text{frequency}=186{,}282*5{,}280/1*10^9=0.98\ \text{ft.}\approx 12\ \text{inches} \quad (1)$$

where:

c is the speed of light (which is effectively the speed at which the packet travels);

frequency is the 1 GHz, corresponding to the 1 GHz clock.

Thus, based on the information obtained from a vehicle, the highway transponder can determine within a foot the approximate location of a car. This allows the highway transponder to provide safety provisions, such as whether a car is approaching another car too quickly, whether it is safe to change lanes, etc.

Since cars may not necessarily have their clocks set for the correct time, vehicle time may be set using a highway transponder. The time that has elapsed for a signal to travel from a vehicle to a highway transponder is $h_{time}-v_{time}=\Delta time$, where $h_{time}$ is highway time and $v_{time}$ is vehicle time. The total distance therefore being $D=\Delta time * D_{min}$.

Figure 5:
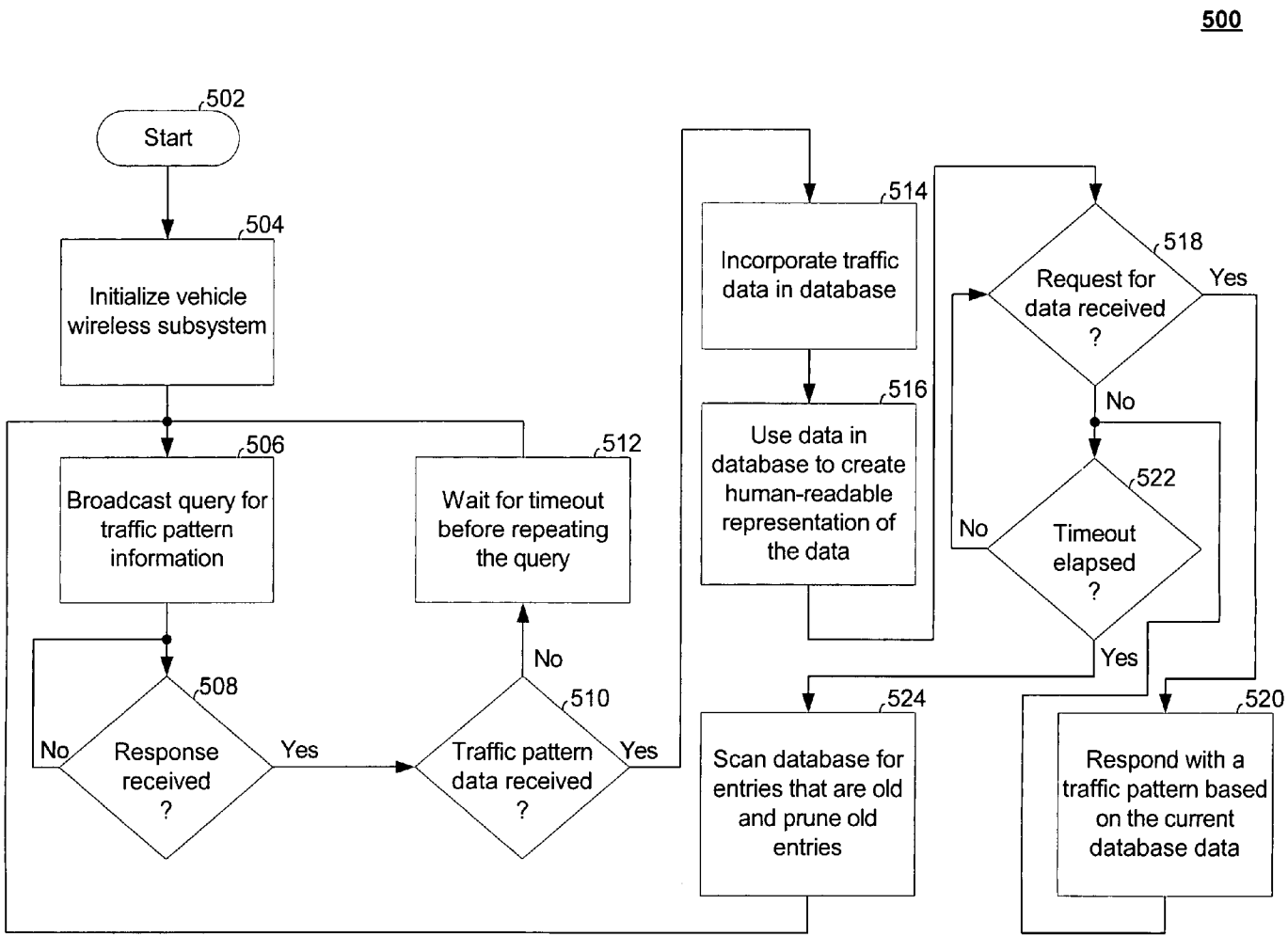
FIG. 5 is a flow diagram describing an exemplary method for real-time traffic information management by a vehicle wireless subsystem according to an embodiment of the present invention.

FIG. 5 is a flow diagram 500 describing an exemplary method for real-time traffic information management by a vehicle wireless subsystem according to an embodiment of the present invention. The invention is not limited to the embodiment described herein with respect to flow diagram 500. Rather, it will be apparent to persons skilled in the relevant art(s) after reading the teachings provided herein that other functional flow diagrams are within the scope of the invention. The process begins with block 502, where the process immediately proceeds to block 504.

In block 504, on starting a vehicle, the vehicle's wireless subsystem, which may include, inter alia, a wireless transponder coupled to a GPS navigation system, is initialized. The initialization process is similar to a computer booting up. The vehicle's infrastructure is turned on and a self-test may be performed. The display for the navigation system may display a start-up screen. The components in the system may be checked to determine if they are working properly. The operating system is booted up as well. Also, files that are considered stale or old, may be removed. The process then proceeds to block 506.

In block 506, a query to obtain traffic pattern information is broadcasted. During this time, the vehicle is searching for any information regarding highway traffic patterns from other vehicles as well as highway transponders, if the vehicle is on the highway.

In decision block 508, it is determined whether a response to the query has been received. Initially, there might not be any vehicles that can provide highway traffic information. In this instance, the process remains at decision block 508 until a response is received. Eventually, the vehicle will come in contact with another vehicle or a highway transponder that will provide it with a response. When a response is received, the process proceeds to decision block 510.

In decision block 510, it is determined whether the response was traffic pattern data. If the response was not traffic pattern data, the process proceeds to block 512, where the process waits for a predetermined timeout before proceeding back to block 506, where another query is broadcasted.

Returning to decision block 510, if it is determined that the response was traffic pattern data, the process proceeds to block 514. In block 514, the traffic pattern data is incorporated into a runtime database for the vehicle navigation system. The incorporation of the traffic pattern data into the runtime database is implementation specific depending on the type of navigation system in the vehicle.

In block 516, the data in the runtime database is used to create a human-readable representation of the data, such as, for example, a map representative of map 300 in FIG. 3. As shown in FIG. 3, map 300 provides real-time traffic pattern data regarding highway traffic conditions to enable a driver to make intelligent choices in determining travel routes.

Returning to FIG. 5, vehicle and/or highway transponders may also desire information from the vehicle's wireless subsystem. In decision block 518, it is determined whether a request for data has been received. If a request for data has been received, the process proceeds to block 520.

In block 520, the vehicle's wireless subsystem responds with a traffic pattern packet based on the data in the current runtime database. In one embodiment, policy may dictate that only a small portion of the latest entries be sent to the requestor. In another embodiment, policy may dictate that half of the current entries be sent to the requester. In yet another embodiment, policy may dictate that all entries be sent to the requestor. In one embodiment, the entries are sent to the requestor via a vehicle to highway packet, such as, but not limited to, vehicle to highway packet 420 in FIG. 4B. The requestor may be a highway transponder and/or another vehicle. The process then proceeds to decision block 522.

Returning to decision block 518, if it is determined that a request has not been received, the process proceeds to decision block 522.

In decision block 522, it is determined whether a predetermined timeout has elapsed. If a predetermined timeout has not elapsed, the process proceeds back to decision block 518 to determine whether a request for data has been received.

Returning to decision block 522, if a predetermined timeout has elapsed, the process proceeds to block 524. In block 524, the database is scanned for entries that are no longer relevant to a real-time traffic pattern. Such entries are pruned from the database. The entries are pruned based on a predetermined length of time (also referred to as stale time) in which information is stored in the database. If data has been stored in the database for at least, or longer, than the stale time, this data may be purged. For example, data collected two or more hours ago may have indicated that traffic on a particular highway was slow or had stopped. That data may now be totally useless. Thus, to prevent such data from being passed to other vehicle or highway transponders, such data may be purged from the database. The process then proceeds back to block 506 to continue to look for up-to-date traffic patterns, to provide the driver with up-to-date maps of traffic patterns, and to provide other vehicle and highway transponders with current traffic information.

Figure 6:
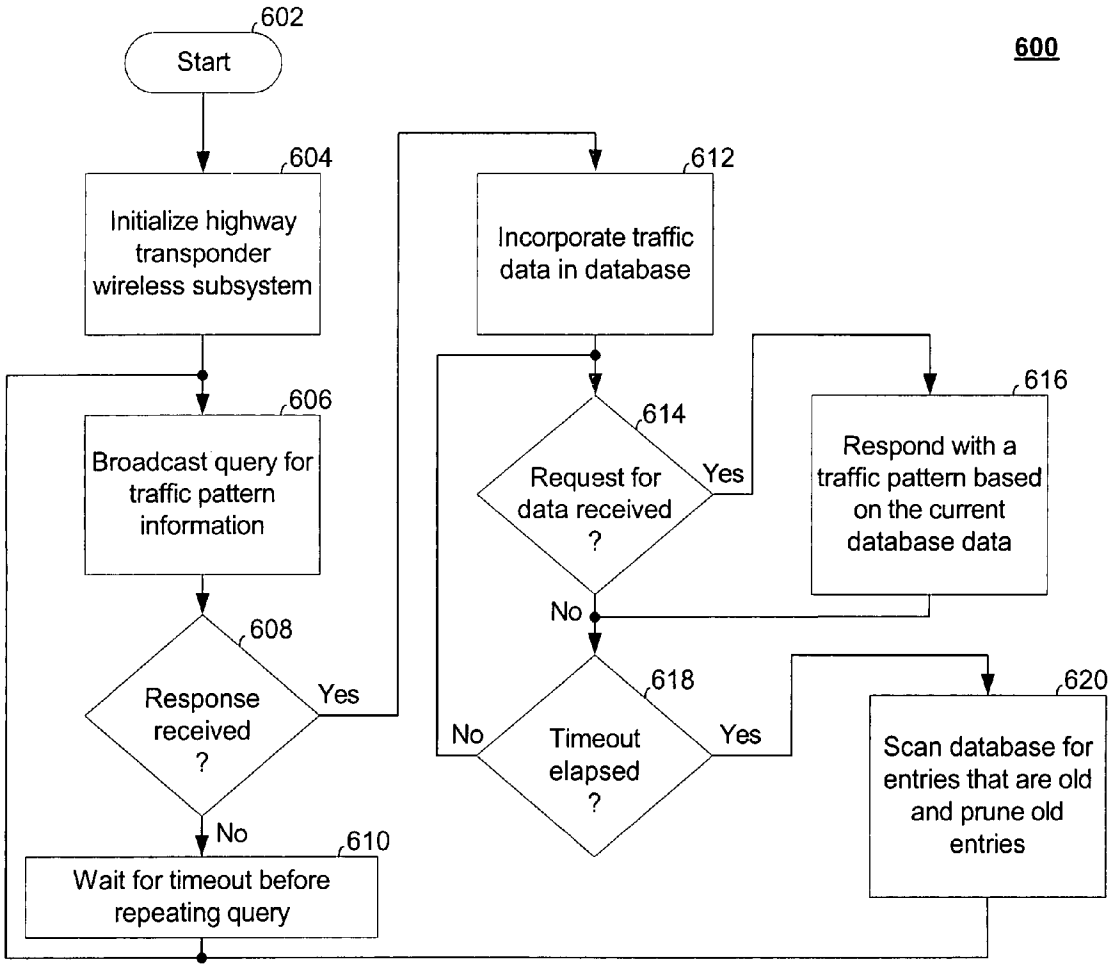
FIG. 6 is a flow diagram describing an exemplary method for real-time traffic information management by a highway transponder wireless subsystem according to an embodiment of the present invention.

FIG. 6 is a flow diagram 600 describing an exemplary method for real-time traffic information management by a highway transponder wireless subsystem according to an embodiment of the present invention. The invention is not limited to the embodiment described herein with respect to flow diagram 600. Rather, it will be apparent to persons skilled in the relevant art(s) after reading the teachings provided herein that other functional flow diagrams are within the scope of the invention. The process begins with block 602, where the process immediately proceeds to block 604.

In block 604, the highway transponder wireless subsystem is initialized. The highway transponder wireless subsystem may include a plurality of highway transponders placed at pre-determined locations along a highway. A full initialization for the highway transponder wireless subsystem may be performed at installation. After installation, in one embodiment, a subsequent initialization process may be waking up a highway transponder from a resting state if no activity has occurred within a certain amount of time, scanning the data files and purging the stale data. Yet, in an embodiment where the highway transponder wireless subsystem never rests, a subsequent initialization process may consist of scanning the data in a highway transponder and purging all stale data at predetermined time intervals. The process then proceeds to block 606.

In block 606, a query is broadcast from a highway transponder to obtain a highway traffic pattern. Each highway transponder is searching for any information regarding highway traffic patterns from vehicles as well as other highway transponders.

In decision block 608, it is determined whether a response to the query was received. If a response has not been received, the process proceeds to block 610, where the process waits for a predetermined timeout to occur before proceeding back to block 606, where another query is broadcast.

Returning to decision block 608, if a response has been received, then the process proceeds to block 612.

In block 612, assuming that the data received is highway traffic pattern data, the highway traffic pattern data is incorporated into the highway transponder runtime database.

Vehicle and other highway transponders may also desire information from a highway transponder. In decision block 614, it is determined whether a request for data from another highway transponder and/or a vehicle has been received. If a request for data from another highway transponder and/or vehicle has been received, the process proceeds to block 616.

In block 616, the highway transponder responds with a traffic pattern packet based on the data in the current runtime database. In one embodiment, policy may dictate that only a small portion of the latest entries be sent to the requestor. In another embodiment, policy may dictate that half of the current entries be sent to the requestor. In yet another embodiment, policy may dictate that all entries be sent to the requestor. In one embodiment, the entries are sent to the requestor via a highway to vehicle packet, such as, but not limited to, highway to vehicle packet 400 in FIG. 4A. The requestor may be another highway transponder and/or a vehicle. The process then proceeds to decision block 618.

Returning to decision block 614, if it is determined that a request has not been received, the process then proceeds to decision block 618.

In decision block 618, it is determined whether a predetermined timeout has elapsed. If the predetermined timeout has not elapsed, the process proceeds back to decision block 614 to determine whether a request for data has been received.

Returning to decision block 618, if the predetermined timeout has elapsed, the process proceeds to block 620. In block 620, the database is scanned for entries that are no longer relevant to a real-time traffic pattern. Such entries are pruned from the database in a similar manner as described above with reference to block 524 in FIG. 5. To prevent old data from being passed to other vehicle or highway transponders, such data may be purged from the runtime database. The process then proceeds back to block 606 to continue to look for up to date traffic patterns and to provide other vehicle and highway transponders with current traffic information.

Certain aspects of embodiments of the present invention may be implemented using hardware, software, or a combination thereof and may be implemented in one or more computer systems or other processing systems. In fact, in one embodiment, the methods may be implemented in programs executing on programmable machines such as mobile or stationary computers, personal digital assistants (PDAs), set top boxes, cellular telephones and pagers, and other electronic devices that each include a processor, a storage medium readable by the processor (including volatile and non-volatile memory and/or storage elements), at least one input device, and one or more output devices. Program code is applied to the data entered using the input device to perform the functions described and to generate output information. The output information may be applied to one or more output devices. One of ordinary skill in the art may appreciate that embodiments of the invention may be practiced with various computer system configurations, including multiprocessor systems, minicomputers, mainframe computers, and the like. Embodiments of the present invention may also be practiced in distributed computing environments where tasks may be performed by remote processing devices that are linked through a communications network.

Each program may be implemented in a high level procedural or object oriented programming language to communicate with a processing system. However, programs may be implemented in assembly or machine language, if desired. In any case, the language may be compiled or interpreted.

Program instructions may be used to cause a general-purpose or special-purpose processing system that is programmed with the instructions to perform the methods described herein. Alternatively, the methods may be performed by specific hardware components that contain hardwired logic for performing the methods, or by any combination of programmed computer components and custom hardware components. The methods described herein may be provided as a computer program product that may include a machine readable medium having stored thereon instructions that may be used to program a processing system or other electronic device to perform the methods. The term "machine readable medium" or "machine accessible medium" used herein shall include any medium that is capable of storing or encoding a sequence of instructions for execution by the machine and that causes the machine to perform any one of the methods described herein. The terms "machine readable medium" and "machine accessible medium" shall accordingly include, but not be limited to, solid-state memories, optical and magnetic disks, and a carrier wave that encodes a data signal. Furthermore, it is common in the art to speak of software, in one form or another (e.g., program, procedure, process, application, module, logic, and so on) as taking an action or causing a result. Such expressions are merely a shorthand way of stating the execution of the software by a processing system to cause the processor to perform an action or produce a result.

While various embodiments of the present invention have been described above, it should be understood that they have been presented by way of example only, and not limitation. It will be understood by those skilled in the art that various changes in form and details may be made therein without departing from the spirit and scope of the invention as defined in the appended claims. Thus, the breadth and scope of the present invention should not be limited by any of the above-described exemplary embodiments, but should be defined in accordance with the following claims and their equivalents.

What is claimed is:

1. A method for peer-to-peer traffic messaging comprising:

initializing a vehicle wireless subsystem;

broadcasting a query to request real-time traffic pattern data, wherein the real-time traffic pattern data comprises traffic pattern data obtained from other vehicle wireless subsystems and highway wireless subsystems; and if a response to the query has been received, incorporating the real-time traffic pattern data into a runtime database and creating a human-readable display for displaying on a navigation system, wherein the human-readable display provides a driver with up-to-date traffic conditions.

2. The method of claim 1, wherein the up-to-date traffic conditions include at least one of free flowing traffic, slow traffic, and stopped traffic.

3. The method of claim 1, wherein the up-to-date traffic conditions comprise up-to-date highway traffic conditions.

4. The method of claim 1, wherein the real-time traffic pattern data comprises traffic pattern data received from at least one highway transponder.

5. The method of claim 1, wherein the real-time traffic pattern data comprises traffic pattern data received from other vehicles.

6. The method of claim 1, wherein prior to incorporating the real-time traffic pattern data into a runtime database, determining whether the response to the query comprises traffic pattern data; and if the response is not traffic pattern data, then waiting for a predetermined timeout to expire; and broadcasting another query to request the real-time traffic pattern data.

7. The method of claim 1, further comprising:

determining whether a request for data has been received; and if a request for data has been received, sending a traffic pattern packet based on data in the runtime database to a requestor.

8. The method of claim 7, wherein the requestor comprises one of a highway transponder and a vehicle transponder.

9. The method of claim 7, wherein if a request for data has not been received and a predetermined timeout has not expired, waiting for the request for data to be received until the predetermined timeout expires; scanning the runtime database for entries that are stale; and purging the stale entries.

10. The method of claim 9, further comprising continuously broadcasting new queries to request the real-time traffic pattern data; continuously incorporating new real-time traffic pattern data into the runtime database and creating the human-readable display for displaying on the navigation system; continuously sending new traffic pattern packets based on new data in the runtime database to requestors; and continuously scanning the runtime database to purge the stale entries.

11. The method of claim 1, further comprising:

determining whether a request for data has been received; and if a request for data has been received and a predetermined timeout has not expired, waiting for an additional request for data to be received until the predetermined timeout expires; scanning the runtime database for entries that are stale; and purging the stale entries.

12. The method of claim 11, further comprising continuously broadcasting new queries to request the real-time traffic pattern data; continuously incorporating new real-time traffic pattern data into the runtime database and creating the human-readable display for displaying on the navigation system; continuously sending new traffic pattern packets based on new data in the runtime database to requestors; and continuously scanning the runtime database to purge the stale entries.

13. A method for peer-to-peer traffic messaging comprising:

initializing a highway transponder wireless subsystem;

enabling a highway transponder to broadcast a query to obtain highway traffic pattern data;

if a response is received, incorporating the highway traffic pattern data into a highway transponder database; and if a response is not received and a first predetermined timeout has expired, enabling the highway transponder to broadcast another query to obtain the highway traffic pattern to incorporate into the highway transponder database.

14. The method of claim 13, further comprising:

determining whether a request for data from another highway transponder or a vehicle transponder has been received; and if the request for data is received, sending the requestor a traffic pattern packet based on data in the highway transponder database.

15. The method of claim 14, further comprising:

determining whether a second predetermined timeout has expired; and if the second predetermined timeout has expired, scanning the highway transponder database for entries that are stale; and purging the stale entries from the highway transponder database.

16. The method of claim 15, further comprising continuously broadcasting new queries to request the real-time traffic pattern data; continuously incorporating new real-time traffic pattern data into the highway transponder database; continuously sending new traffic pattern packets based on new data in the highway transponder database to requestors; and continuously scanning the highway transponder database to purge the stale entries.

17. A peer-to-peer traffic messaging system comprising:

a plurality of highway transponder subsystems, each highway transponder subsystem including a plurality of highway transponders dispersed on highways to transmit and receive traffic pattern data and highway memory to store the traffic pattern data; and a plurality of vehicle transponder subsystems, each vehicle transponder subsystem housed inside of a vehicle, each vehicle transponder subsystem including a vehicle transponder to transmit and receive the traffic pattern data, vehicle memory to store the traffic pattern data, and a navigation system to display the traffic pattern data in a human readable format to a driver to enable the driver to view up-to-date traffic conditions, wherein the display includes free-flowing traffic, slow moving traffic, and stopped traffic on a map to allow the driver to change a planned travel route if slow and stopped traffic pattern conditions exist on the planned travel route.

18. The system of claim 17, wherein highway transponders and vehicle transponders that are capable of communicating with each other perform peer-to-peer communications to exchange current traffic pattern data.

19. The system of claim 17, wherein each highway transponder subsystem further comprises a processor, the processor configured to:

initialize the highway transponder system;

enable the highway transponders to broadcast queries to obtain the traffic pattern data;

incorporate the traffic pattern data received from other highway transponders and vehicle transponders into a runtime database;

share the traffic pattern data in the runtime database with the other highway transponders and vehicle transponders;

scan the runtime database for stale data; and purge the stale data.

20. The system of claim 17, wherein each vehicle transponder subsystem further comprises a processor, the processor configured to:

initialize the vehicle transponder subsystem;

enable the vehicle transponders to broadcast queries to obtain the traffic pattern data;

incorporate the traffic pattern data received from the highway transponders and other vehicle transponders into a runtime database;

display the traffic pattern data in a human readable format on the navigation system;

share the traffic pattern data in the runtime database with the other highway transponders and vehicle transponders;

scan the runtime database for stale data; and purge the stale data.

21. An article comprising: a storage medium having a plurality of machine accessible instructions, wherein when the instructions are executed by a processor, the instructions provide for initializing a vehicle wireless subsystem;

broadcasting a query to request real-time traffic pattern data, wherein the real-time traffic pattern data comprises traffic pattern data obtained from other vehicle wireless subsystems and highway wireless subsystems; and if a response to the query has been received, incorporating the real-time traffic pattern data into a runtime database and creating a human-readable display for displaying on a navigation system, wherein the human-readable display provides a driver with up-to-date traffic conditions.

22. The article of claim 21, wherein the up-to-date traffic conditions include at least one of free flowing traffic, slow traffic, and stopped traffic.

23. The article of claim 21, wherein prior to instructions for incorporating the real-time traffic pattern data into a runtime database, further comprising instructions for determining whether the response to the query comprises traffic pattern data; and if the response is not traffic pattern data, waiting for a predetermined timeout to expire; and broadcasting another query to request the real-time traffic pattern data.

24. The article of claim 21, further comprising instructions for:

determining whether a request for data has been received; and if a request for data has been received, sending a traffic pattern packet based on data in the runtime database to a requestor.

25. The article of claim 24, wherein the requestor comprises one of a highway transponder and a vehicle transponder.

26. The article of claim 24, wherein if a request for data has not been received and a predetermined timeout has not expired, further comprising instructions for waiting for the request for data to be received until the predetermined timeout expires; scanning the runtime database for entries that are stale; and purging the stale entries.

27. The article of claim 26, further comprising instructions for continuously broadcasting new queries to request the real-time traffic pattern data; continuously incorporating new real-time traffic pattern data into the runtime database and creating the human-readable display for displaying on the navigation system; continuously sending new traffic pattern packets based on new data in the runtime database to requestors; and continuously scanning the runtime database to purge the stale entries.

28. The article of claim 21, further comprising instructions for:

determining whether a request for data has been received; and if a request for data has been received and a predetermined timeout has not expired, waiting for an additional request for data to be received until the predetermined timeout expires; scanning the runtime database for entries that are stale; and purging the stale entries.

29. The article of claim 28, further comprising instructions for continuously broadcasting new queries to request the real-time traffic pattern data; continuously incorporating new real-time traffic pattern data into the runtime database and creating the human-readable display for displaying on the navigation system; continuously sending new traffic pattern packets based on new data in the runtime database to requestors; and continuously scanning the runtime database to purge the stale entries.

30. An article comprising: a storage medium having a plurality of machine accessible instructions, wherein when the instructions are executed by a processor, the instructions provide for initializing a highway transponder wireless subsystem;

enabling a highway transponder to broadcast a query to obtain highway traffic pattern data;

if a response is received, incorporating the highway traffic pattern data into a highway transponder database; and if a response is not received and a first predetermined timeout has expired, enabling the highway transponder to broadcast another query to obtain the highway traffic pattern to incorporate into the highway transponder database.

31. The article of claim 30, further comprising instructions for:

determining whether a request for data from another highway transponder or a vehicle transponder has been received; and if the request for data is received, sending the requestor a traffic pattern packet based on data in the highway transponder database.

32. The article of claim 31, further comprising instructions for:

determining whether a second predetermined timeout has expired; and if the second predetermined timeout has expired, scanning the highway transponder database for entries that are stale; and purging the stale entries from the highway transponder database.

33. The article of claim 32, further comprising instructions for continuously broadcasting new queries to request the real-time traffic pattern data; continuously incorporating new real-time traffic pattern data into the highway transponder database; continuously sending new traffic pattern packets based on new data in the highway transponder database to requestors; and continuously scanning the highway transponder database to purge the stale entries.

* * * * *